US008393465B2

(12) United States Patent
Clark et al.

(10) Patent No.: US 8,393,465 B2
(45) Date of Patent: Mar. 12, 2013

(54) POCKET-SIZE HYBRID CONTAINER FOR CONSUMER ITEMS

(75) Inventors: James L. Clark, Richmond, VA (US); William T. Griffin, Chesterfield, VA (US); Robert T. Mitten, Glen Allen, VA (US)

(73) Assignee: Philip Morris USA Inc., Richmond, VA (US)

( * ) Notice: Subject to any disclaimer, the term of this patent is extended or adjusted under 35 U.S.C. 154(b) by 286 days.

(21) Appl. No.: 12/149,603

(22) Filed: May 5, 2008

(65) Prior Publication Data

US 2009/0014343 A1 Jan. 15, 2009

Related U.S. Application Data

(60) Provisional application No. 60/924,829, filed on Jun. 1, 2007, provisional application No. 60/924,279, filed on May 7, 2007.

(51) Int. Cl.
*A24F 23/00* (2006.01)

(52) U.S. Cl. ..... 206/242; 206/247; 206/265

(58) Field of Classification Search ..... 206/236–242, 206/247–248, 253, 260–262, 264–265, 270, 206/276; 220/527, 23.9, 23.87, 23.89
See application file for complete search history.

(56) References Cited

U.S. PATENT DOCUMENTS

| | | | | |
|---|---|---|---|---|
| 411,773 | A | | 10/1889 | Atkinson |
| D26,315 | S | | 11/1896 | Miller |
| D28,413 | S | | 3/1898 | Taite |
| 663,415 | A | | 12/1900 | Charles |
| 2,051,777 | A | * | 8/1936 | Purinton et al. ..... 312/31 |
| 2,157,255 | A | * | 5/1939 | Bumpass ..... 229/5.5 |
| D193,219 | S | | 7/1962 | Burdick et al. |
| 3,206,016 | A | | 9/1965 | Fowle et al. |
| 3,871,543 | A | * | 3/1975 | Chadfield et al. ..... 215/12.1 |
| 4,098,421 | A | | 7/1978 | Foster |
| 4,190,170 | A | | 2/1980 | Boyd |
| 4,440,307 | A | * | 4/1984 | Bartels et al. ..... 220/4.21 |
| 4,646,933 | A | | 3/1987 | Jurczenia et al. |

(Continued)

FOREIGN PATENT DOCUMENTS

| | | |
|---|---|---|
| CH | 694145 A5 | 8/2004 |
| FR | 2361278 A | 3/1978 |

(Continued)

OTHER PUBLICATIONS

International Search Report and Written Opinion mailed Jan. 7, 2009 for PCT/IB2008/001836.

(Continued)

*Primary Examiner* — J. Gregory Pickett
*Assistant Examiner* — Robert Poon
(74) *Attorney, Agent, or Firm* — Buchanan Ingersoll & Rooney PC

(57) ABSTRACT

A three-piece pocket-size hybrid container for holding a consumer product such as smokeless tobacco product in an interior volume of an inner ring mechanically secured to an interior of an outer base housing including a cover to fit over and snugly around the inner ring. When closed, a cover sidewall may engage a sidewall of the outer base housing to form a flush exterior sidewall of the closed container or the cover sidewall may be spaced apart from the outer base housing to form a gap in the exterior sidewall of the closed container. The outer base housing and cover can be metal and the inner ring can be plastic to provide a strong and robust package that maintains product freshness and is easily opened and closed.

29 Claims, 9 Drawing Sheets

U.S. PATENT DOCUMENTS

| | | | | |
|---|---|---|---|---|
| 4,715,496 | A | 12/1987 | Hackmann | |
| 4,850,504 | A | 7/1989 | Grindrod et al. | |
| 5,259,526 | A | 11/1993 | Stolzman | |
| 5,460,287 | A | 10/1995 | Cargile et al. | |
| 5,676,272 | A | 10/1997 | Baerenwald | |
| 5,791,473 | A | 8/1998 | Decker et al. | |
| 5,794,814 | A | 8/1998 | Baerenwald | |
| 6,620,444 | B1 * | 9/2003 | Reichinger | 426/115 |
| D494,474 | S | 8/2004 | Houk et al. | |
| D499,025 | S | 11/2004 | Houk et al. | |
| D510,524 | S | 10/2005 | Houk et al. | |
| D512,636 | S | 12/2005 | Pace | |
| D513,386 | S | 1/2006 | Pace et al. | |
| D514,936 | S | 2/2006 | Pace et al. | |
| D515,426 | S | 2/2006 | Pace et al. | |
| D515,429 | S | 2/2006 | Pace | |
| D515,439 | S | 2/2006 | Pace | |
| D515,928 | S | 2/2006 | Pace | |
| D518,728 | S | 4/2006 | Frantz | |
| D523,752 | S | 6/2006 | Bried et al. | |
| D531,036 | S | 10/2006 | Bried et al. | |
| D541,176 | S | 4/2007 | Bried | |
| 7,878,324 | B2 * | 2/2011 | Bellamah et al. | 206/236 |
| 8,215,482 | B2 * | 7/2012 | Cronin et al. | 206/236 |
| 2006/0060480 | A1 | 3/2006 | Budd | |
| 2006/0101564 | A1 | 5/2006 | Powdermaker | |
| 2006/0118589 | A1 | 6/2006 | Arnarp et al. | |
| 2007/0012711 | A1 | 1/2007 | Kutsch et al. | |
| 2007/0110928 | A1 * | 5/2007 | Bried et al. | 428/34.1 |
| 2007/0130811 | A1 * | 6/2007 | Shevelev et al. | 40/312 |
| 2009/0230003 | A1 | 9/2009 | Thiellier | |

FOREIGN PATENT DOCUMENTS

| | | | |
|---|---|---|---|
| GB | 1004671 | A | 9/1965 |
| WO | WO 2007/034332 | A2 | 3/2007 |
| WO | WO 2008/148701 | A1 | 12/2008 |
| WO | WO 2009/092823 | A1 | 7/2009 |
| WO | WO 2009/106493 | A1 | 9/2009 |

OTHER PUBLICATIONS

Partial International Search Report dated Oct. 13, 2008 for PCT/IB2008/001836.

* cited by examiner

POCKET-SIZE HYBRID CONTAINER FOR CONSUMER ITEMS

RELATED APPLICATIONS

This application claims priority under 35 U.S.C. §119(e) to U.S. Provisional Application No. 60/924,829 entitled "Pocket-Size Hybrid Container for Consumer Items," filed Jun. 1, 2007 and U.S. Provisional Application No. 60/924,279 entitled "A Pocket-Size Hybrid Container for Consumer Products," filed May 7, 2007, the entire contents of which are incorporated herein by reference.

SUMMARY

A three-piece hybrid container adapted to hold consumer items, such as smokeless tobacco products, and in particular a pocket-size container that has a lid over a dual-wall base to provide strength, maintain freshness of the consumer items, and facilitate opening and closing of the container.

DETAILED DESCRIPTION

Figure 1A:
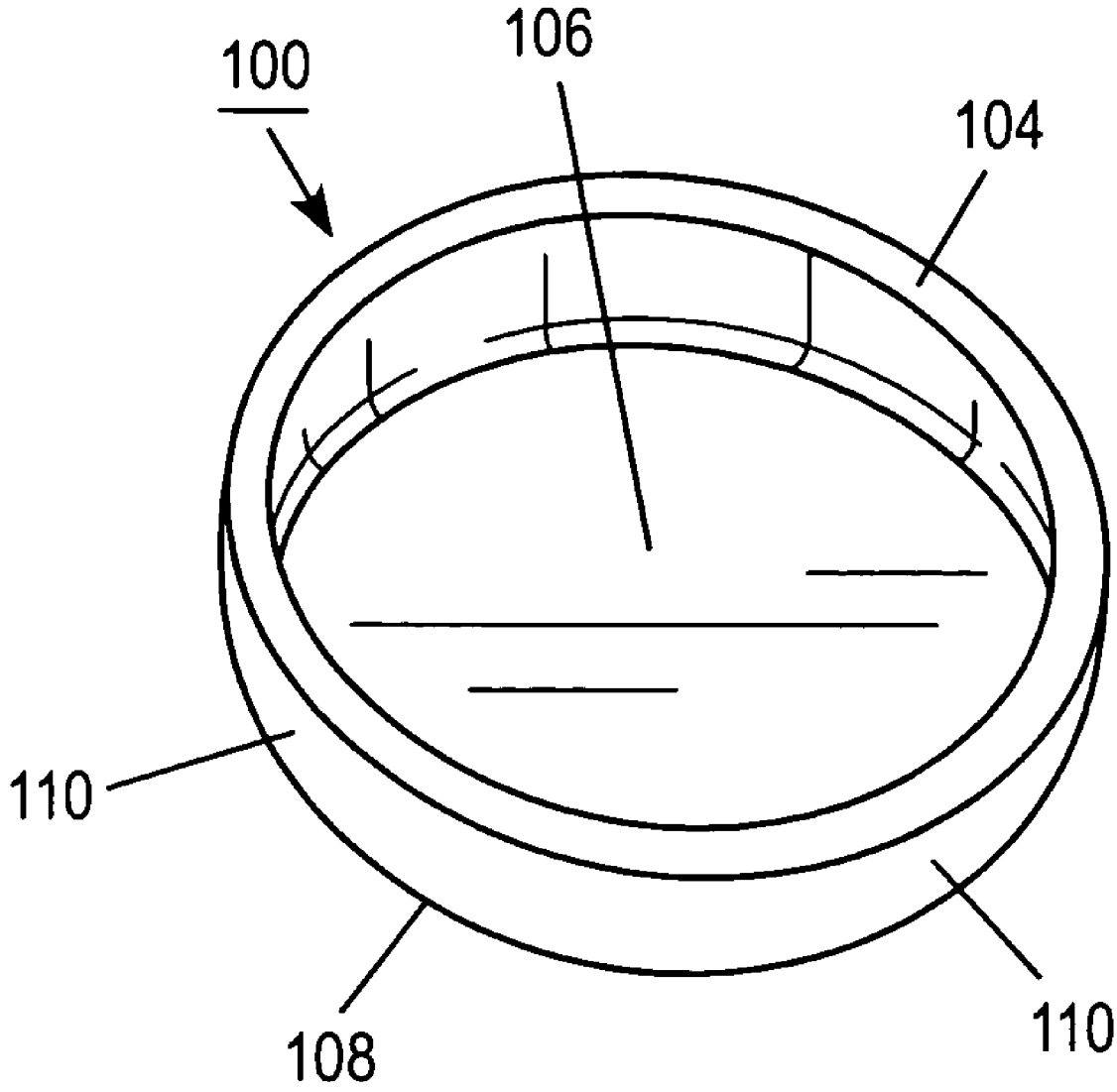
FIGS. 1A-1C show an embodiment of a cover to an embodiment of a hybrid container, the cover having a round shape with corners rounded with a smooth radius.

As described herein, a three-piece pocket-size hybrid container has an inner ring secured to the inside of an outer base housing and a cover to snugly close over the inner ring.

In an embodiment, the cover and outer base housing are of one material and the inner ring is of a second material. In a preferred embodiment, the cover and outer base housing are metal and the inner ring is plastic, the inner ring providing a mechanical connection with the base and a friction fit with the cover such that the cover and base are supported only by the inner ring. The hybrid container preferably contains consumer items within an interior volume defined by the space within the inner ring.

Preferably, the hybrid container outer base housing and cover are shaped with all edges rounded with a smooth radius. This gives an appealing feel to the hybrid container when handled or placed in a pocket. More preferably, the hybrid container is cylindrical with a round cover and round outer base housing, although in other embodiments the hybrid container may have other shapes such as cuboid.

Preferably, the outer base housing fits securely around the inner ring. Preferably, the sidewall of the cover surrounds the inner ring to form a snug closure over the inner ring. The cover sidewall may extend downward to meet the sidewall of the outer base housing such that the hybrid container has a solid flush sidewall when closed. In other preferred embodiments the cover sidewall extends downward toward the sidewall of the outer base housing such that an annular gap extends around the periphery of the hybrid container between the cover sidewall and the outer base housing sidewall when the hybrid container is closed.

In a preferred embodiment, the outside of the hybrid container cover and/or outer base housing will be pre-printed and treated with a protective scratch resistant textured material such as a polymer coating. Preferably, the inside of the hybrid container cover and outer base housing will be treated with a corrosion-resistant coating such as an epoxy coating for corrosion protection. The cover and/or the outer base housing may have a top and bottom recessed panel. Such a recessed panel is preferred to allow for embossing, labeling, ink jet printing, onserting, and other similar applications.

In a preferred embodiment, the edge of the cover sidewall is rolled inwardly. The rolled edge engages the outer surface of the inner ring to provide a friction fit around the inner ring. Preferably, the top of the inner ring is tapered to allow easy positioning or alignment of the cover rolled edge around the top of the inner ring and to make a snug closure of the hybrid container when the cover and base are squeezed towards each other. The inner ring preferably contacts the bottom of the base and the top of the cover when the cover is closed.

In a preferred embodiment, the hybrid container has a 42/58% split ratio of cover height to outer base housing height. That is, the cover overlies about 42% of the height of the inner ring and the base overlies about 58% of the inner ring. The parting line between the cover and the outer base housing is thus located such that 42% of the hybrid container height may be partitioned to the cover and 58% of the hybrid container height may be partitioned to the outer base housing. Such a preferred split ratio is proportioned to indicate to a user an upright position during cover removal with the thinner cover (lid) being oriented above the base. However, the split ratio can have any other desired value. For example, the hybrid container may have a split ratio in a range of 70% to 30% of the container height partitioned to the cover height and correspondingly 30% to 70% partitioned to the outer base housing height. In an embodiment, the split ratio can also be selected to achieve a certain desired internal volume consistent with the amount of product to be stored in the hybrid container. For example, the hybrid container can be 25 mm high and have a 68 mm diameter. In such an embodiment, the cover height can be 10.5 mm and the outer base housing height can be 14.5 mm.

In an embodiment, the inner ring is a single piece of injection molded plastic such as low density polyethylene resin. Suitable plastics include, without limitation, polypropylene, polyethylene, polystyrene, nylon, polysulfone, polyester, polyurethane, and combinations thereof. Because some plastics absorb flavors, the preferred plastic is polypropylene if the enclosed product includes flavors.

In one embodiment, the cover and outer base housing are formed of a metal stamping. Suitable metals, include without limitation aluminum, aluminum alloys, steels, stainless steel alloys, titanium, titanium alloys, magnesium, magnesium alloys, tin, tin alloys, copper, copper alloys, brasses, and combinations thereof. The cover and base are preferably identical in shape with the only differences being the height of the sidewall and width of the inwardly rolled edge.

Preferably, the inner ring provides a seal to the hybrid container cover. Also preferably, the inner ring facilitates removing the cover and replacing the cover to open and close the hybrid container. In a preferred embodiment the seal is not hermetic, but is optimized such that the product is allowed to off-gas and yet retain freshness. In a preferred embodiment, the inner ring has one or more channels, vents and/or ribs to allow egress of gas and to facilitate easier opening and closing of the hybrid container.

In an embodiment, the inner ring has a snap ring around the outer periphery such that when opening and closing the hybrid container the cover sidewall elastically expands and/or the inner ring elastically contracts to pass a protrusion of the cover sidewall over the snap ring. The protrusion may be, for example, an inwardly rolled edge of the cover sidewall or annular projection forming another snap ring on the interior of the cover sidewall.

In the preferred embodiment, the inner ring is mechanically secured to the outer base housing. Preferably, the inner ring is secured to the outer base housing by a machine curl on the base as described later with reference to FIGS. 3B and 4B. Also, preferably, no adhesives or glues are used to aid in securing the inner ring to the outer base housing, but such adhesives may be used if desired. Preferably, the inner ring is secured such that the bottom of the inner ring makes a tight seal against the bottom of the outer base housing.

The inner ring preferably includes a tapered bottom wall with an annular step located approximately midway between the top and bottom of the inner ring. The preferred location of the annular step may be selected so that the hybrid container has a split ratio of cover height to outer base housing height in the range of 70:30 to 30:70. Preferably, the location of the annular step may be selected so that the split ratio of cover height to outer base housing height is 42:58. Such an arrangement allows the inner ring to be snap fitted in the base with the bottom of the ring contacting the bottom panel of the base, the sidewall of the base contacting the tapered wall and the step contacting the machine curl of the base sidewall.

While the inner ring is preferably secured to the outer base housing by a machine curl, other mechanical joints can be used. For example, an embodiment may include dimpling the outer base housing to clamp the inner ring securely to the outer base housing. Right-handed or left-handed threads may also be used to screw the inner ring into the outer base housing or a combination of machine curling, dimpling, and/or threads may be used.

While a friction fit is preferably used to hold the cover to the inner ring, the cover may be held by other arrangements. For example, the inner ring may be threaded on the exterior surface of the upper portion surrounded by the cover. The interior surface of the cover sidewall may have matching threads such that rotation of the cover relative to the outer base housing opens the container and rotation in an opposite direction closes the cover while the inner ring is clamped within the base to prevent the inner ring from turning.

In an embodiment, a membrane seal (FIG. 7A) surrounds the periphery of the hybrid container. The membrane overlaps the parting line seam between the cover and the outer base housing. Preferably, the membrane seal is a pressure sensitive clear label applied to the surface of the container sidewall. Also preferably, the membrane seal may be used as a tamper evident seal. Also preferably, the membrane material may be polypropylene. While the membrane seal is preferably polypropylene, the membrane seal may be other suitable materials such as heat shrinkable polyolefin film.

In a preferred embodiment, the membrane seal is perforated to allow for appropriate hybrid container breathe-ability. Also preferably, the membrane seal covers the circumference of the hybrid container and is positioned to center such perforations across the parting line of the cover and outer base housing or gap between the spaced apart cover and outer base housing when the hybrid container is closed. The use of perforated membranes improves the ability to open the hybrid container. In use, the consumer breaks the seal at the perforation prior to opening the hybrid container. In another embodiment, the membrane seal includes a pull tab that is engaged to break the seal of the membrane and provide access to the contents of the hybrid container.

The three-piece pocket-size hybrid container has an inner ring secured to the inside of an outer base housing and a cover to snugly close over a protruding portion of the inner ring. As illustrated in FIG. 1A, a cover 100 (shown in an inverted position) consists of a top portion 106 to cover an interior volume of the hybrid container, a flange portion 110 which engages the inner ring, and a lip portion 104 which engages an upper edge of the outer base housing or is spaced apart from the upper edge of the outer base housing. The cover top portion 106 joins the flange portion 110 in a rounded corner 108 having a smooth radius. Although the top portion 106 is shown as circular in the preferred embodiment, other embodiments may have other shapes such as square. In such an alternate embodiment, the flange portion 110 would have four sidewalls (not shown) joined to each other and to the top portion 106 with rounded corners.

Figure 1B:
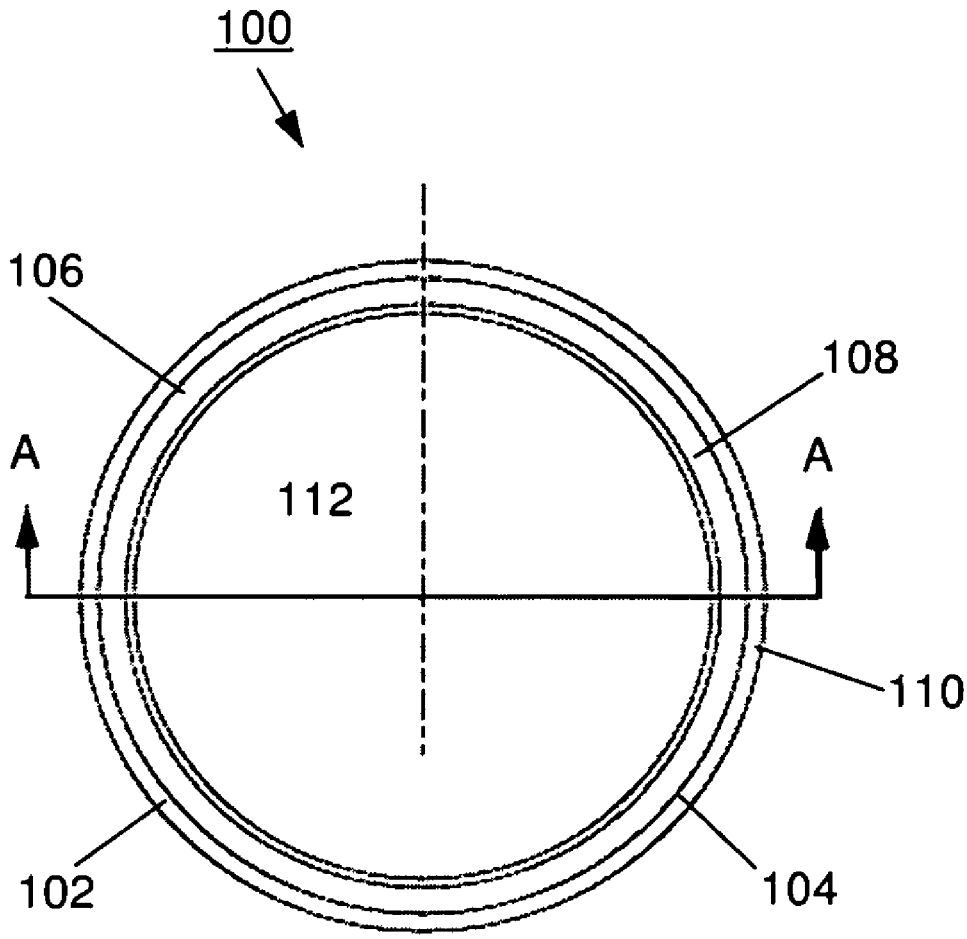
Figure 1C:
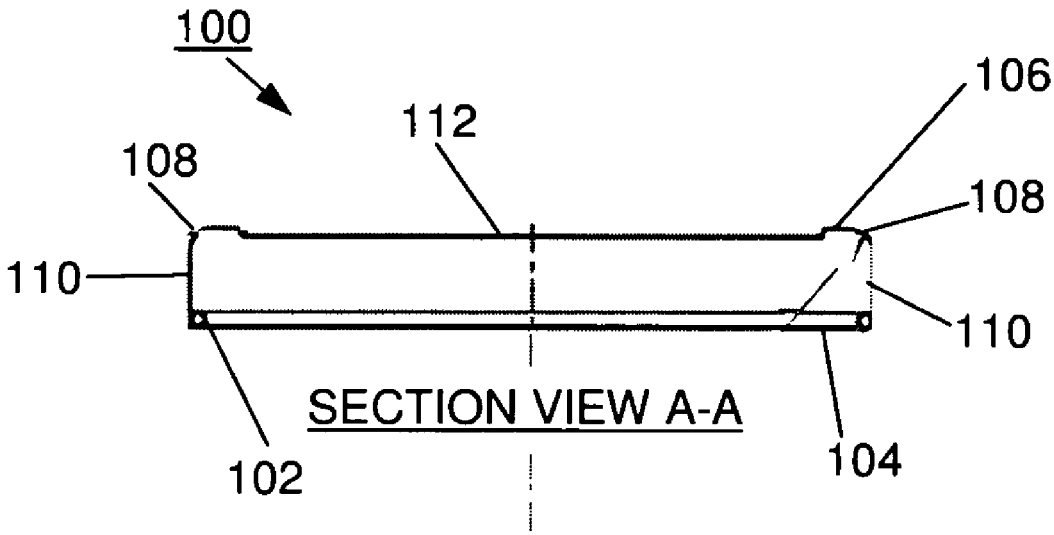

FIG. 1B shows a plan view of the hybrid container cover 100 and FIG. 1C shows a cross section of the cover 100 sectioned along A-A in FIG. 1B. The cover 100 has a recessed top panel 112 to accept a label (not shown). The interior of the cover flange portion 110 fits snugly around the protruding portion of the inner ring to close the hybrid container. Preferably, a lip of the cover flange 110 is rolled inward and the rolled edge 102 engages the inner ring to snugly close the hybrid container.

Figure 2A:
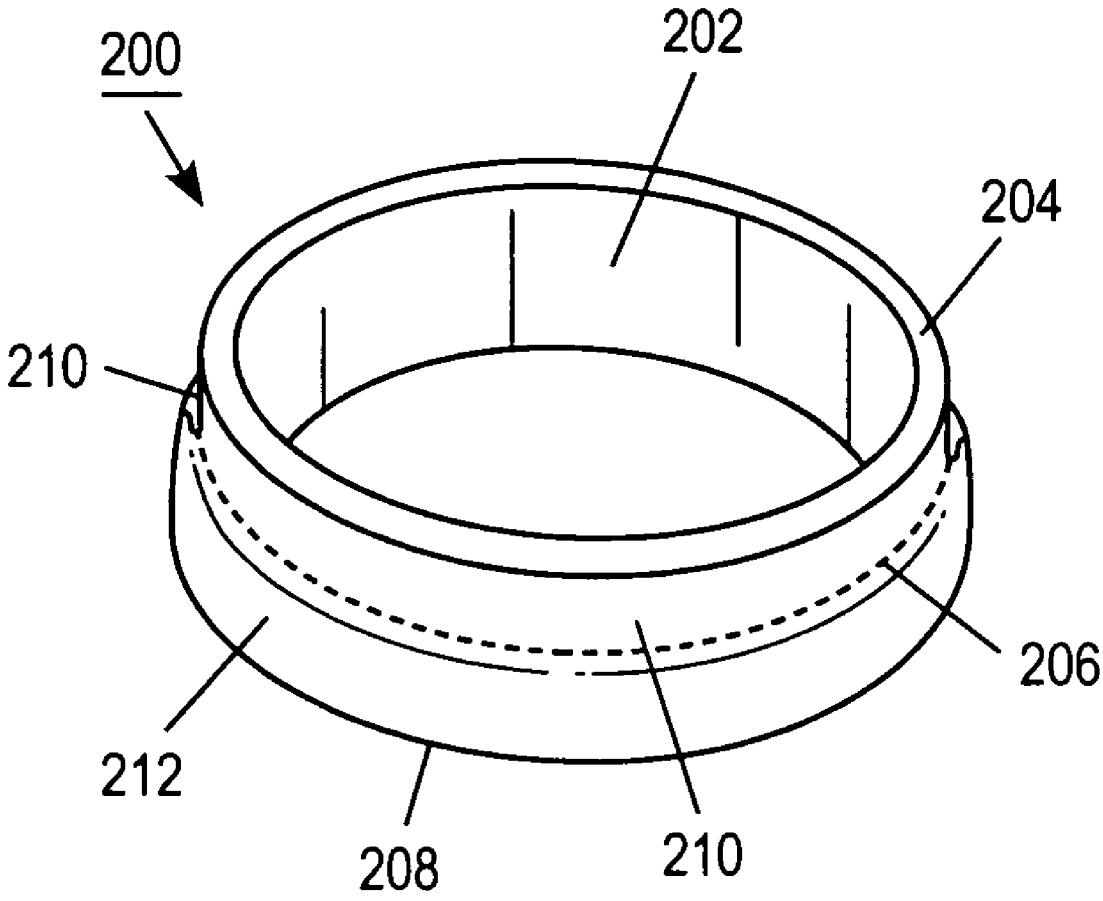
FIGS. 2A-2C illustrate an embodiment of an inner ring to the hybrid container.

The inner ring 200 of the hybrid container 100 is shown in FIG. 2A. The inner ring 200 has an interior surface 202, an upper lip 204, a protruding portion 210, a step 206 in an exterior surface of the inner ring 200 to make a mechanical joint with the outer base housing, a lower portion 212 which fits snugly within the outer base housing, and the lower portion including a rounded edge 208. Although the step 206 is shown as extending around the periphery of the inner ring 200, this is not required in all embodiments, for example, the step 206 could be one or more discrete depressions or recesses in the lower portion 212 to accept mating projections on the outer base housing or vice versa. In a preferred embodiment, the lower portion 212 is tapered to provide a smaller outer diameter at its bottom edge and facilitate insertion of the inner ring in the base to lock the upper edge of the base over the step 206.

Figure 2B:
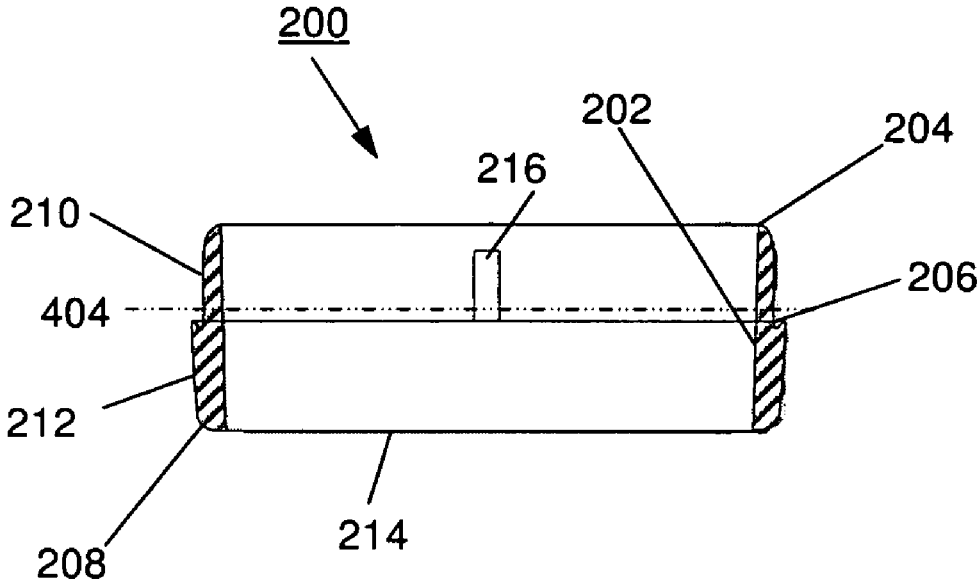
Figure 2C:
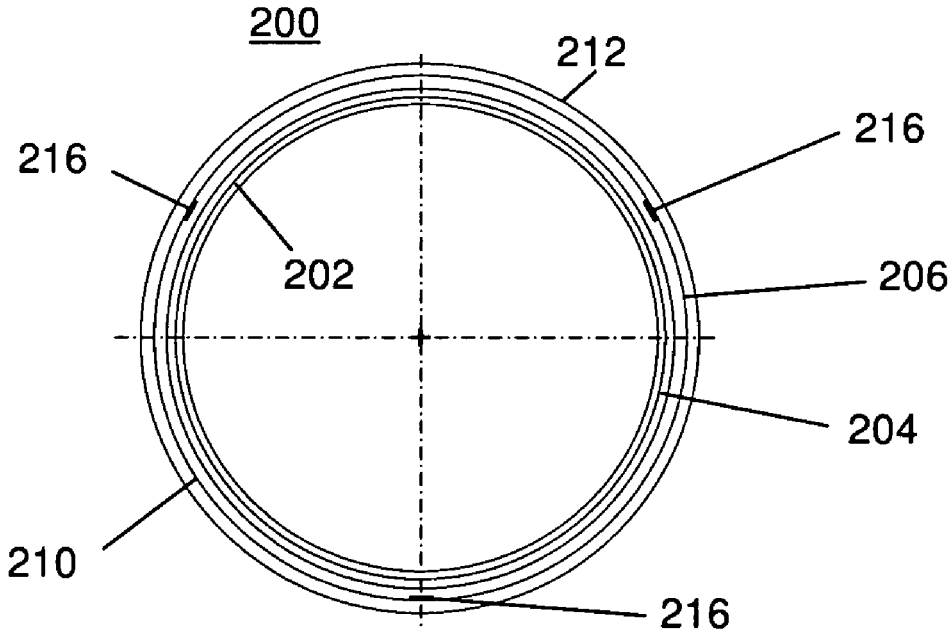

FIG. 2B and FIG. 2C illustrate a cross-section and plan view of the inner ring 200, respectively. The inner ring 200 may have at least one vertically extending channel 216 to allow egress of gas to and/or from the interior of the hybrid container to maintain freshness of the product contained therein and to facilitate easier opening and closing of the hybrid container when in use. Air flows through the vertically extending channels 216 past the rolled edge 102 of the cover 100 into an interior space of the hybrid container when the cover 100 is lifted away from the outer base housing. Conversely, air flows out of the interior space of the hybrid container through the vertically extending channels 216 past the rolled edge of the cover 102 when the cover is pressed down on the inner ring protruding portion 210 toward the outer base housing to close the hybrid container.

The vertically extending channels 216 may extend partially up the protruding portion 210 as shown in FIG. 2B or all the way to the upper lip 204. The vertically extending channels 216 may vary in width to adjust the amount of air flow past the rolled edge 102. In other embodiments the channel 216 may be replaced or combined with any suitable air passage arrangement such as grooves, vents and/or ribs. In a preferred embodiment, the inner ring 200 has three channels 216 distributed evenly around the circumference of the protruding portion 210.

The upper lip 204 of the inner ring 200 may be tapered to facilitate alignment and placement of the cover 100 over the inner ring 200. The taper angle is not limited and may be adjusted such that a gradual increase in pressure is required as the cover 100 approaches a closed position.

Although the inner ring 200 is shown as circular in the preferred embodiment, other embodiments may have other shapes such as substantially square. In such an alternate embodiment, the inner ring 200 would have four sidewalls (not shown) joined to each other with rounded corners to fit snugly within an outer base housing having the same shape.

Figure 3A:
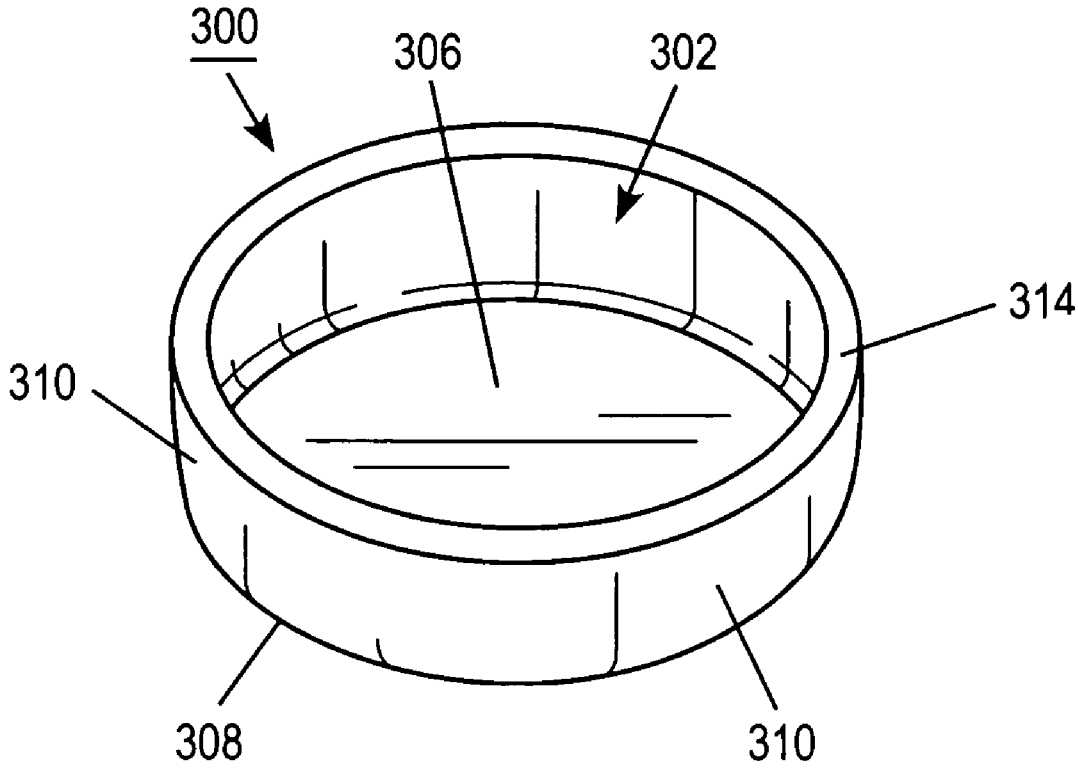
FIGS. 3A and 3B illustrate an embodiment of an outer base housing to the hybrid container, the outer base housing having a round shape with corners rounded with a smooth radius.
Figure 3B:
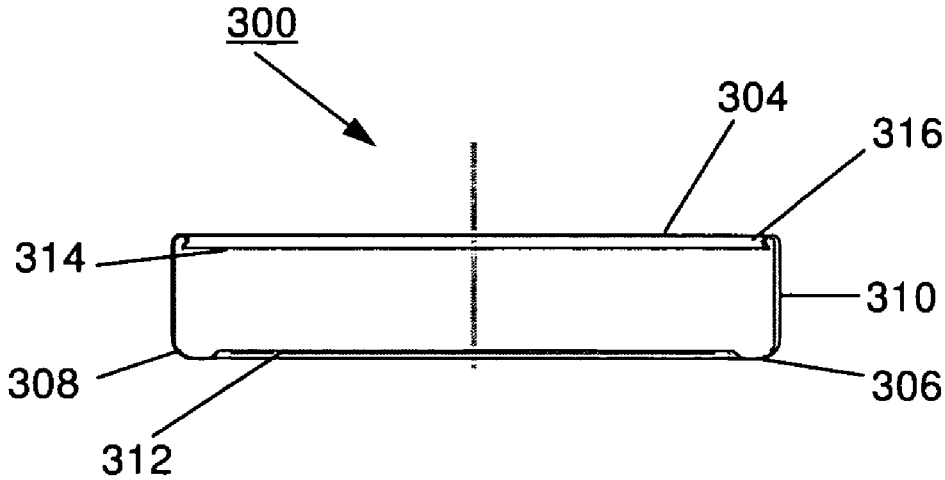

FIG. 3A shows the outer base housing 300 of the pocket-size hybrid container. The outer base housing 300 has a bottom portion 306 of a size and shape to substantially match the top portion 106, a sidewall portion 310 joined to the bottom portion 306 in a rounded corner 308 with a smooth radius, and a sidewall upper lip 314. FIG. 3B shows a cross-section of the outer base housing 300 having a recessed panel 312 and the sidewall upper lip 314 curled to form a ridge portion 316 that protrudes toward the interior of the outer base housing 302. The ridge portion 316 protrudes above the step 206 of the inner ring 200 to securely attach the inner ring 200 to the outer base housing 300.

Although the bottom portion 306 is shown as circular in the preferred embodiment, other embodiments may have other shapes such as square. In such an alternate embodiment, the sidewall portion 310 would have four sidewalls (not shown) joined to each other and to the bottom portion 306 with rounded corners.

Figure 4A:
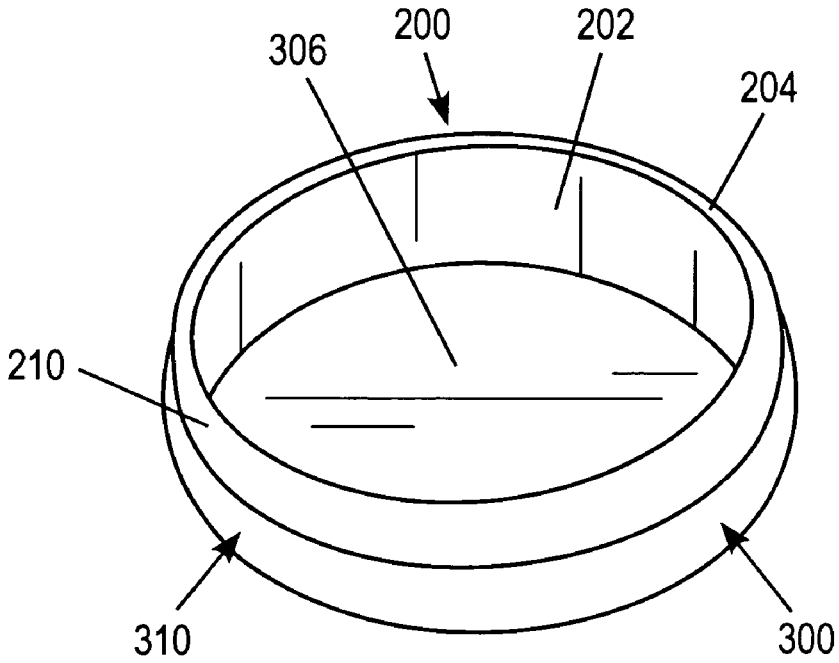
FIGS. 4A and 4B show an embodiment of the hybrid container with the base housing inner ring of FIG. 2A inserted in the outer base housing of FIG. 3A.
Figure 4B:
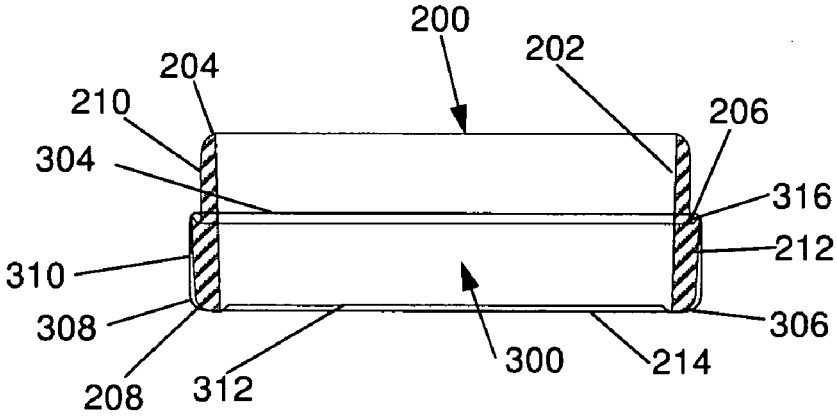

FIG. 4A illustrates the inner ring 200 secured within the outer base housing 300. A cross-section of the inner ring 200 secured within the outer base housing 300 is shown in FIG. 4B. The outer base housing 300 sidewall portion 310 snugly surrounds the lower portion 212 of the inner ring 200. The ridge portion 316 protrudes over the step 206 to clamp the inner ring to the outer base housing. FIG. 4B shows the bottom of the inner ring 214 is tightly sealed against the bottom of the outer housing 306. The inner ring protruding portion 210 extends above an upper rim 304 of the outer base housing 300. The inner volume of the container is defined between the inner surface of the inner ring, the bottom panel of the base and top panel of the cover, the inner ring providing a mechanical joint with the base and friction fit with the cover.

Figure 5:
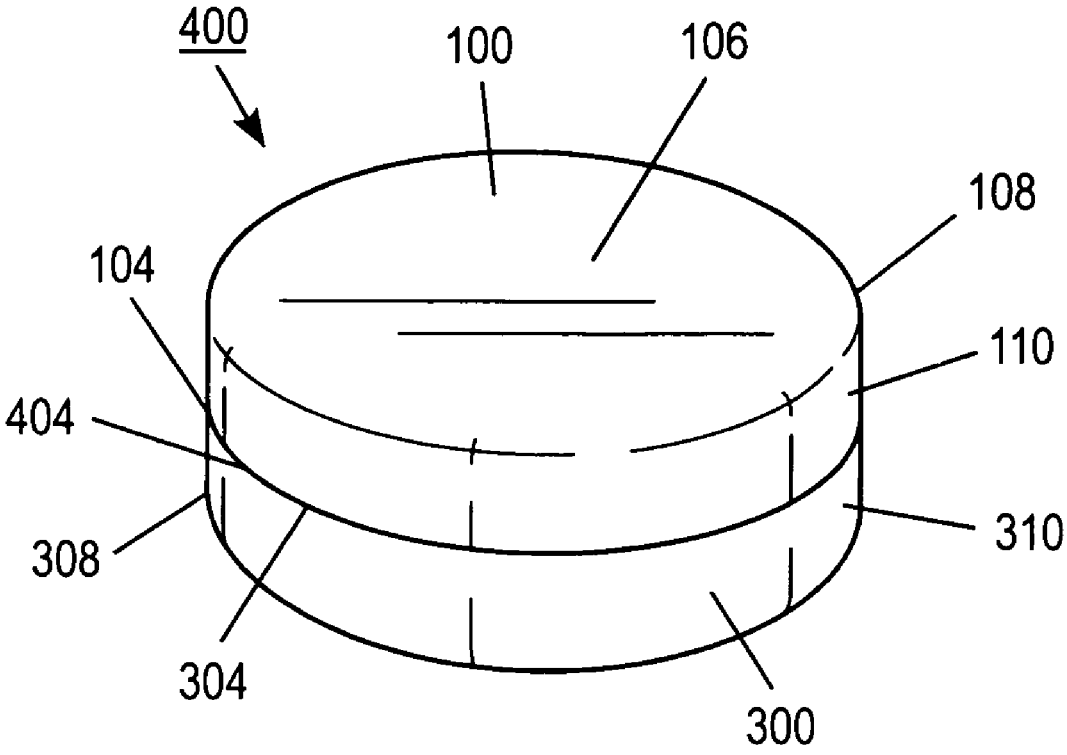
FIG. 5 is an embodiment of a hybrid container, the cover and outer base housing having round shape with corners rounded with a smooth radius.

FIG. 5 illustrates the pocket-size hybrid container 400 having the cover 100 closed over the outer base housing 300. The lip portion 104 of the cover 100 proximately meets the upper rim 304 of the outer base housing 300 forming the container parting line 404. The sidewall portion 310 and the flange portion 110 form a solid flush container sidewall. The container parting line 404 can be as shown or higher or lower on the container sidewall.

Figure 6A:
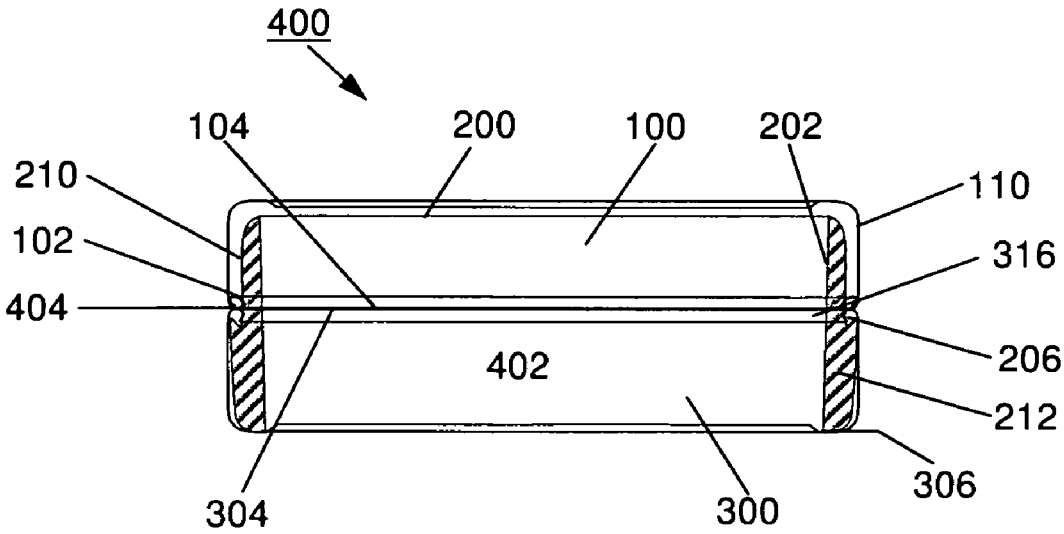
FIGS. 6A and 6B illustrate embodiments of the hybrid container with the cover of FIG. 1A closed over the inner ring of FIG. 2A inserted in the outer base housing of FIG. 3A.

FIG. 6A shows a cross-section view of the pocket-size hybrid container 400 having the cover 100 closed over the outer base housing 300. As seen in FIG. 6A, the rolled edge 102 of flange portion 110 snugly surrounds the protruding portion 210 of the inner ring 200. The lower portion 212 fits snugly within the outer base housing 300, secured by the ridge portion 316 fitted over the step 206. The cover lip portion 104 engages the upper rim 304 of the outer base housing 300. Thus, an interior volume 402 is defined between the cover 100, the interior surface 202 and the bottom portion 306. In an embodiment, the interior volume 402 contains consumer products. Preferably, the product is moist smokeless tobacco (MST).

Figure 6B:
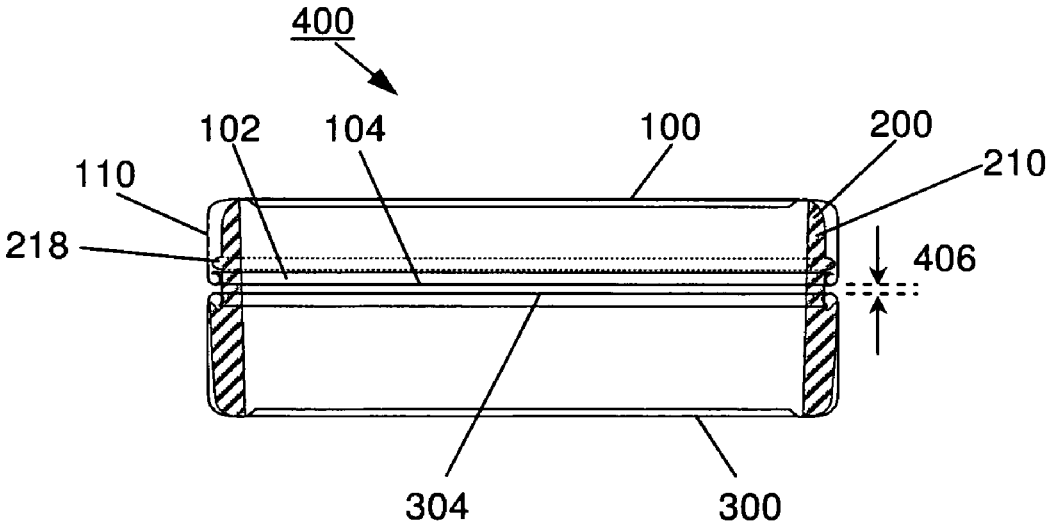

FIG. 6B shows another embodiment of the pocket-size hybrid container 400 having the cover 100 closed over the outer base housing 300. As seen in FIG. 6B, the cover flange portion rolled edge 102 snugly surrounds the inner ring protruding portion 210. The inner ring lower portion 212 is locked within the outer base housing 300, secured by the ridge portion 316 fitted over the step 206. In the closed position, the cover lip portion 104 is spaced apart from the upper rim 304 such that a gap 406 extends around the circumference of the hybrid container 400 between the cover and the outer base housing.

FIG. 6B shows an optional annular ridge 218 on the external surface of the protruding portion 210. The ridge 218 acts as a snap ring to latch the cover closed. The cover sidewall 110 moves elastically outward and/or the inner ring moves elastically inward to pass the rolled edge 102 slidably over the ridge 218 to open and close the hybrid container 400. The annular ridge 218 engages the rolled edge 102 to securely close the hybrid container 400. The position of the ridge 218 is not particularly limited and can be as shown in FIG. 6B or higher or lower. The position of the snap ring may depend on the height of the cover flange 110. The snap ring may be a continuous or discontinuous ridge. The snap ring can be in an embodiment with or without the gap 406. The gap 406 can be in an embodiment of the hybrid container 400 with or without the snap ring ridge 218.

Figure 7A:
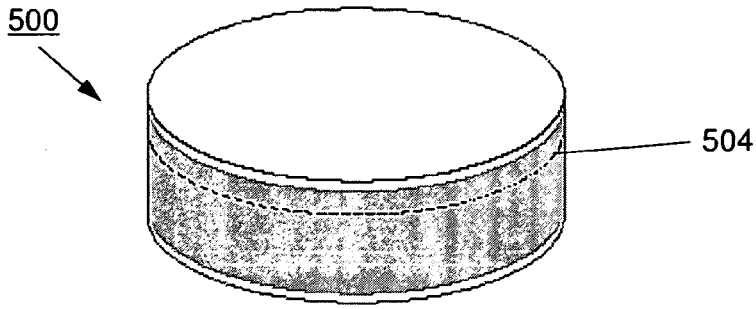
FIG. 7A illustrates an embodiment of a perforated label around a periphery of an embodiment of the hybrid container and FIGS. 7B-7F illustrate embodiments of a perforated label prior to placing around a periphery of a hybrid container.

FIG. 7A shows a membrane seal 500 surrounding the periphery of the hybrid container 400. The membrane seal 500 overlaps the parting line 404 seam between the hybrid container cover 100 and the hybrid container outer base housing 300. In an embodiment, the membrane seal 500 is a pressure sensitive clear label. Preferably, the membrane seal 500 may be used as a tamper evident seal. Also preferably, the membrane material is polypropylene. However, the membrane seal may be other suitable materials such as heat shrinkable polyolefin film.

As seen in FIG. 7A, the membrane seal 500 may be perforated 504 according to a preferred embodiment to allow for hybrid container breathe-ability. Also shown in FIG. 7A, the membrane seal 500 covers the circumference of the hybrid container 400 (FIG. 5) and may be positioned to center such perforations 504 across the parting line 404 of the cover 100 and outer base housing 300 or the gap 406 between the cover 100 and outer base housing when the hybrid container 400 is closed. The parting line 404 position and the gap 406 position can be as shown by perforations 504, or higher or lower. Likewise, the perforations 504 can be as shown or higher or lower.

Figure 7B:
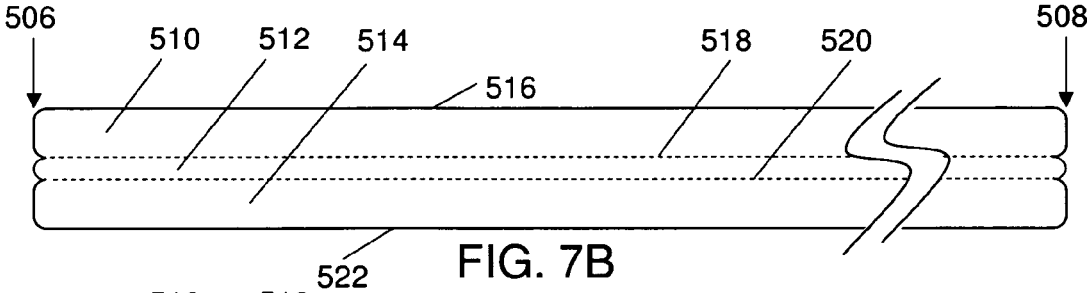

FIGS. 7B-7F show embodiments of the membrane seal 500 prior to placement around the periphery of the hybrid container 400. As shown in FIG. 7B, the membrane seal 500 has a first terminal end 506 and second terminal end 508 which can overlap, meet at a vertical seam or be separated by a gap when the membrane seal 500 is attached to the container sidewall.

The membrane seal 500 preferably has a plurality of horizontal sections separated by perforations 504. For example, an upper section 510 separated from a mid section 512 by a first row of perforations 518, and a lower section 514 separated from the mid section 512 by a second row of perforations 520. Preferably, inner surfaces of upper and lower sections 510, 514 are bonded to the cover sidewall 110 and base sidewall 310, respectively, such that the container can be opened after the mid section 512 is removed by breaking perforations 518, 520. In such an embodiment the mid section 512 is known as a tear-off strip of a tamper evident seal. Preferably, the inner surfaces of upper and lower sections 510, 514 are bonded to the cover sidewall 110 and base sidewall 310 by a pressure sensitive adhesive.

While the inner surfaces of upper and lower sections 510, 514 are preferably bonded to the cover sidewall 110 and base sidewall 310, the upper and lower sections 510, 514 may also be not bonded such that the membrane seal 500 may optionally be completely removed when the tear-off strip 512 is severed. For example, the membrane seal 500 can be shrink fit to the periphery of the container 400 optionally covering the sidewall, the sidewall and portions of the top and/or bottom, or the entire container. In such an embodiment, the membrane 500 may be completely removed from the container 400 after the tear-off strip 512 is removed.

Figure 7C:
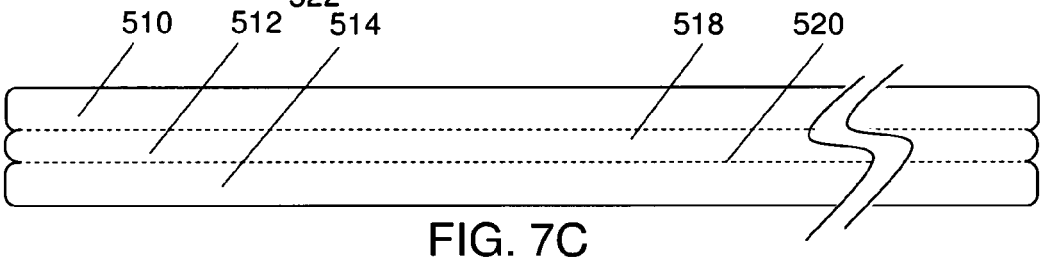

Preferably, the widths of the upper and lower sections 510, 514 are the same and the width of the mid section 512 is the same, wider or narrower than the upper and lower sections 510, 514. FIG. 7B shows the mid section 512 narrower than the upper and lower sections 510, 514 and FIG. 7C shows the mid section 512 approximately the same width as the upper and lower sections 510, 514. Although not required, the upper and lower sections 510, 514 may overlap the corners of the container 108, 308. The terminal ends of the horizontal sections 510, 512, 514 may be flush or rounded to facilitate attaching the membrane seal 500 to the container and locating, lifting and/or gripping the tear-off strip to open the container.

Figure 7D:
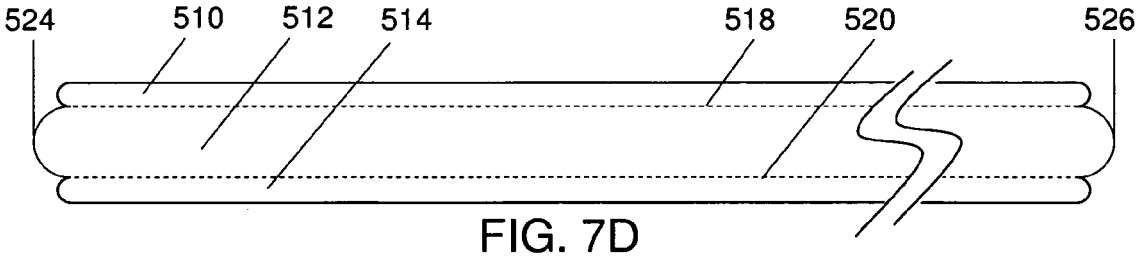

FIG. 7D shows a preferred embodiment where the terminal ends 524, 526 of the mid section 512 extend beyond the terminal ends of the upper and lower sections 510, 514. Preferably, the mid section terminal ends 524, 526 are rounded and can be pull tabs for tearing off the mid section 512. Also preferably, the mid section 512 is wider than the upper and lower sections 510, 514.

Figure 7E:
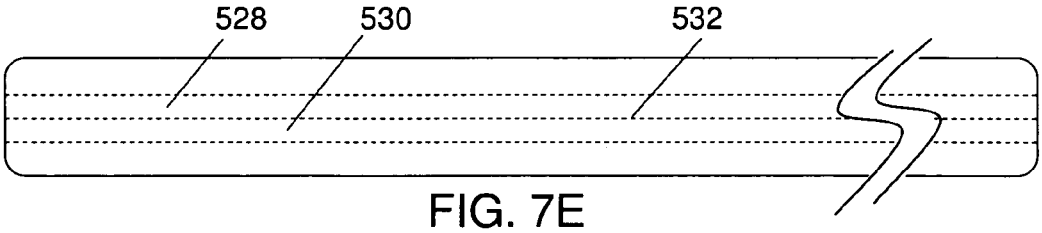

FIG. 7E shows an embodiment where a perforation 532, divides the mid section 512 into two mid sections 528, 530. In such an embodiment, mid sections 528, 530 can be removed simultaneously or consecutively. That is, pulling on a first terminal end of the upper mid section 528 initially removes the upper mid section 528 around the circumference of the container 400. A second terminal end of the upper mid section 528 being connected to a terminal end of the lower mid section 530 removes the lower mid section 530 from the periphery of the container 400 leaving the upper and lower sections 510, 514 attached to the cover and base allowing the container to be opened.

Figure 7F:
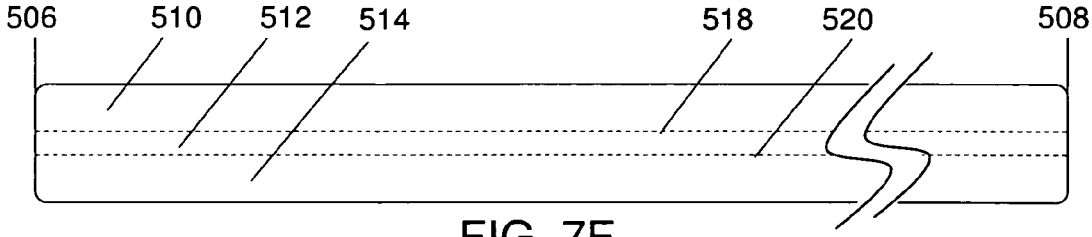

FIG. 7F shows an embodiment where the terminal ends 506, 508 of the membrane seal 500 are flush. The mid section 512 between rows of perforations 518 and 520 is shown narrower than the upper and lower sections 510, 514.

Although not limited, the membrane seal 500 may be 10-15 mm wide. Preferably 12 mm wide. The upper and lower sections 510, 514 may each be 2-7 mm wide and the mid section 512 width may be 1-8 mm wide. Preferably, the mid section 512 is 6 mm wide and the upper and lower sections 510, 514 are each 3 mm wide.

In an embodiment, the pocket-size hybrid container 400 is about 30 mm to about 100 mm in diameter, and about 15 mm to about 40 mm in height. In a preferred embodiment, the hybrid container 400 fits in the palm of an adult user's hand or in a pocket. Most preferably, the size of the interior volume 402 is determined based on the amount of product to be enclosed.

Assembly of a hybrid container is very simple. The inner ring is inserted into the outer base housing 300 and pressed down until the upper lip 314 of the outer base housing 300 is snapped over the step of the inner ring 206. The cover 100 can be installed on the protruding portion 210 of the inner ring 200.

In use, a consumer grips the underside of the hybrid container 400 in the palm of his/her hand, while lifting the cover 100 away from the outer base housing 300 to expose the consumer products stored within the interior volume 402.

The particular dimensions and proportions of the hybrid container are not critical. The proportions are preferably selected to provide a hybrid container which is sized to accommodate the particular items to be packaged therein. Thus, the actual hybrid container could be more elongated than shown in the drawings, or the hybrid container could be more nearly square, i.e., deeper than shown in the drawings. Preferably, however, the hybrid container is sized so it can be conveniently carried in a pocket, and held in a hand and opened by a consumer.

The items can be arranged in various ways. For example, the products could be arranged with the items overlapped or staggered relative to one another. Of course, if the products are small enough, they could be randomly placed in the interior volume 402.

The container could, of course, be used for a variety of products. One specific product for which the hybrid container can be used is smokeless pouched tobacco. Such tobacco can be provided in packets, sometimes known as "snus" and comprise individual packets of tobacco material.

It will be appreciated from the foregoing that there is provided an inexpensive pocket-size container capable of holding multiple items, and capable of being held and opened by a consumer.

It should be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. For example, the inner ring 200 may have a bottom portion (not shown) to line the outer base housing bottom portion 306, the inner ring 200 may have a hollow wall, or the shape of the container my vary from circular to other shapes, such as cuboid or other polyhedron with smoothly rounded corners. Accordingly, exemplary embodiments, as well as alternative embodiments, may be made without departing from the spirit and scope of the articles and methods as set forth in the attached claims.

What is claimed is:

1. A pocket-size hybrid container for use with consumer products comprising:

an outer base housing having a bottom portion and a sidewall portion;

an inner ring located inside the outer base housing such that a protruding portion of the inner ring extends above the sidewall portion of the outer base housing; and a cover having a top portion and downwardly extending flange portion which fits snugly around the protruding portion of the inner ring thereby defining an interior volume within the inner ring and bottom portion of the outer base housing, wherein the downwardly extending flange extends downward from the top portion a distance in a range of between 30% to 50% of the distance from the top portion to the bottom portion when the cover closes the container, wherein the sidewall portion of the outer base housing extends upwardly from the bottom portion such that when the container is closed, the sidewall of the outer base housing and the downwardly extending flange form an outer flush surface, and wherein the outer base housing is locked onto the inner ring by a snap fit connection between the outer base housing and the inner ring, the snap fit connection formed between an inwardly rolled edge located at a top edge of the sidewall portion of the outer base housing and an annular step formed on an outer surface of the inner ring, the inner ring having a tapered outer surface extending from the annular step to the bottom portion of the outer base housing.

2. The pocket-size hybrid container for use with consumer products of claim 1, wherein the container is a three-piece container consisting of the cover, outer base housing and inner ring, the outer base housing is metal, the cover is metal, and the inner ring is rigid plastic.

3. The pocket-size container for use with consumer products of claim 2, wherein the inner ring further comprises a bottom portion which covers an inner surface of the bottom portion of the outer base housing.

4. The pocket-size hybrid container for use with consumer products of claim 2, wherein the inner ring is a single piece of injection molded plastic.

5. The pocket-size hybrid container of claim 4, wherein the inner ring is injection molded of a material selected from the group consisting of polypropylene, polyethylene, polystyrene, nylon, polysulfone, polyester, polyurethane, and combinations thereof.

6. The pocket-size hybrid container for use with consumer products of claim 2, further comprising a corrosion resistant coating on at least one of the interior of the outer base housing and the interior of the cover.

7. The pocket-size hybrid container for use with consumer products of claim 6, wherein the corrosion resistant coating is an epoxy coating.

8. The pocket-size hybrid container for use with consumer products of claim 1, wherein:

the bottom portion is substantially round;

the sidewall portion is substantially cylindrical;

the sidewall portion joins the bottom portion in a rounded corner with a smooth radius;

the cover top portion is substantially round in a size to match the bottom portion and joins the downwardly extending flange in a rounded corner with a smooth radius.

9. The pocket-size hybrid container for use with consumer products of claim 1, wherein an external surface of the protruding portion of the inner ring is tapered toward an upper edge of the protruding portion to fit within the downwardly extending flange of the cover and the exterior surface of the protruding portion below the tapered upper edge provides a friction fit with the downwardly extending flange of the cover.

10. The pocket-size hybrid container for use with consumer products of claim 1, further comprising:

a printed label on at least one of an exterior surface of the outer base housing and an exterior surface of the cover; and a scratch resistant textured coating on the exterior and/or interior surfaces of the outer base housing and the cover.

11. The pocket-size hybrid container for use with consumer products of claim 10, wherein at least one of the cover and the bottom portion of the outer base housing further comprise a recessed panel to accept one from the group of embossing, labeling, onsetting applications, ink jet printing or a combination thereof.

12. The pocket-size hybrid container for use with consumer products of claim 1, wherein the downwardly extending flange extends downward from the top portion 40% to 45% of the distance from the top portion to the bottom portion when the cover closes the container.

13. The pocket-size hybrid container for use with consumer products of claim 1, wherein the cover is secured to the inner ring by a friction fit therebetween.

14. The pocket-size hybrid container for use with consumer products of claim 13, wherein the downwardly extending flange comprises a rolled edge that forms a seal with the inner ring.

15. The pocket-size hybrid container for use with consumer products of claim 14, wherein the inner ring external surface comprises a ridge, to engage the rolled edge of the downwardly extending flange, the downwardly extending flange and/or the inner ring elastically deforming when the rolled edge passes over the ridge.

16. The pocket-size hybrid container for use with consumer products of claim 14, wherein the inner ring comprises at least one air passage through which air escapes past the rolled edge when the downwardly extending flange descends around the inner ring to close the container and through which air enters past the rolled edge when the downwardly extending flange ascends along the inner ring to open the container.

17. The pocket-size hybrid container for use with consumer products of claim 16, wherein the inner ring comprises a plurality of air passages evenly spaced around a periphery of the inner ring.

18. The pocket-size hybrid container for use with consumer products of claim 14, wherein the seal allows off-gassing while retaining freshness of the consumer products contained in the container.

19. The pocket-size hybrid container for use with consumer products of claim 1, wherein the protruding portion of the inner ring comprises one from the group consisting of channels, ribs, grooves or combination thereof to vent the interior volume and facilitate opening and closing of the container.

20. The pocket-size hybrid container for use with consumer products of claim 1, further comprising a perforated membrane covering a parting line around a periphery of the container, the parting line formed between a downward edge of the downwardly extending flange and an upper edge of the sidewall portion when the container is closed.

21. The pocket-size hybrid container for use with consumer products of claim 20, wherein the membrane is one of pressure sensitive, shrink-fit, and combinations thereof.

22. The pocket-size hybrid container for use with consumer products of claim 21, wherein the membrane is one of polypropylene, polyolefin and combinations thereof.

23. The pocket-size hybrid container for use with consumer products of claim 21, wherein the membrane comprises a tamper evident pull tab used to break the membrane for opening the container.

24. The pocket-size hybrid container for use with consumer products of claim 21, wherein the membrane further comprises:

a plurality of horizontal sections divided by horizontal rows of perforations, the plurality of sections comprising:

an uppermost section bonded to the cover flange outer wall, a lowermost section bonded to the base outer wall, and at least one mid section to be removed by breaking at least two rows of perforations to allow the container to be opened after removal of the mid section.

25. The pocket-size hybrid container for use with consumer products of claim 24, wherein at least one terminal end of the at least one horizontal mid section extends beyond terminal ends of the remaining horizontal sections and is rounded for ease of finger gripping and pulling.

26. The pocket-size hybrid container for use with consumer products of claim 25, wherein the membrane is removable after the at least one horizontal mid section is removed.

27. The pocket-size hybrid container for use with consumer products of claim 1, wherein the interior volume contains a plurality of consumer products.

28. The pocket-size hybrid container for use with consumer products of claim 27, wherein the consumer products are smokeless tobacco pouches.

29. The pocket-size hybrid container for use with consumer products of claim 1, wherein the consumer products include moist smokeless tobacco (MST).

* * * * *